United States Patent [19]

Baroi

[11] 4,361,324

[45] Nov. 30, 1982

[54] APPARATUS FOR PHYSICAL CULTURE AND PHYSIOTHERAPY

[76] Inventor: Stephan I. Baroi, 8, Avenue de Miremont, 1206 Geneva, Switzerland

[21] Appl. No.: 72,769

[22] Filed: Sep. 5, 1979

[30] Foreign Application Priority Data

Oct. 10, 1978 [CH] Switzerland ..... 1048378

[51] Int. Cl.[3] ..... A63B 13/00

[52] U.S. Cl. ..... 272/123; 272/94; 272/142; 272/119; 272/122; 272/127; 272/138

[58] Field of Search ..... 272/123, 122, 124; 285/298, 302, 417

[56] References Cited

U.S. PATENT DOCUMENTS

| | | | |
|---|---|---|---|
| 793,101 | 6/1905 | Schmidt . | |
| 1,019,584 | 3/1912 | Balston | 272/122 |
| 1,019,861 | 3/1912 | Titus | 272/138 |
| 1,536,048 | 5/1925 | Alastalo . | |
| 3,311,374 | 3/1967 | Wittenberg et al. | 272/123 |
| 3,785,644 | 1/1974 | Bradley et al. . | |
| 3,904,198 | 9/1975 | Jones | 272/123 |
| 4,076,236 | 2/1978 | Ionel | 272/123 |
| 4,199,140 | 4/1980 | Ferretti | 272/123 |
| 4,252,316 | 2/1981 | Price | 272/123 |

FOREIGN PATENT DOCUMENTS 8410 of 1907 United Kingdom .

*Primary Examiner*—Richard C. Pinkham
*Assistant Examiner*—William R. Browne
*Attorney, Agent, or Firm*—Young & Thompson

[57] ABSTRACT

The apparatus for physical culture and physiotherapy comprises a set of different hollow interchangeable members made from a plastics material. It comprises, for example, two hollow bodies (1), each having the filling opening sealed by a plug and two tubular skirts (3,4) having on their outer or inner walls respectively a thread which constitutes a coupling. The two hollow bodies are fixed to the ends of a connecting bar formed by the assembly of three rectilinear elements (7) in order to form a dumb-bell. The latter also has at its ends two supplementary hollow bodies (1'), identical to the two first hollow bodies and separated therefrom by a supplementary rectilinear element (7'). A sleeve (12) is mounted so as to rotate freely on each of the two supplementary rectilinear elements, so as to provide a more complete apparatus and offering more different possibilities of use than a conventional dumb-bell.

3 Claims, 11 Drawing Figures

FIG.9
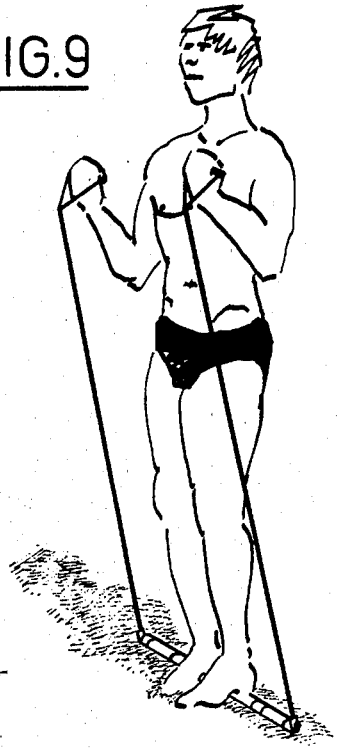
FIG.8
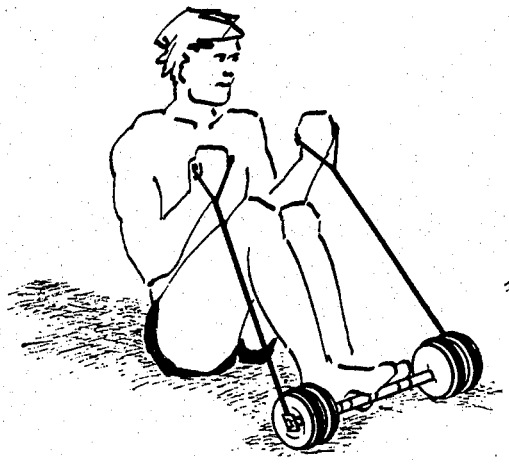
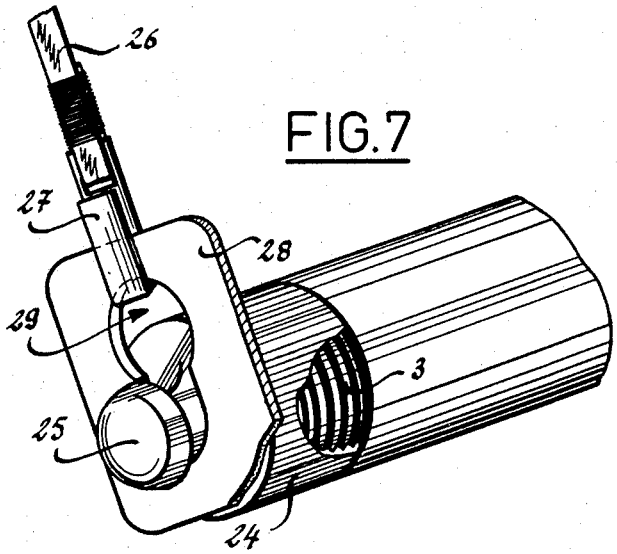
FIG.7

APPARATUS FOR PHYSICAL CULTURE AND PHYSIOTHERAPY

The present invention relates to an apparatus for physical culture and physiotherapy in the form of a set of different interchangeable members.

A plurality of different types of dumb-bells for physical culture are already known, but they have the disadvantage of being heavy, bulky and cumbersome and it is also necessary for the user to have a number of different weights and connecting bar lengths. The dumb-bell described in U.S. Pat. No. 4,076,236 partly obviates these disadvantages and comprises a grip and at least two hollow bodies coupled in a detachable manner at each end of the grip. The assembly is made from a plastics material and the hollow bodies can be filled with a material such as water, sand, lead, etc, as a function of the desired weight. However, this dumb-bell does not have other interchangeable members permitting its use for exercises other than those performed with a small dumb-bell provided with a grip.

The object of the present invention is to provide an apparatus having a plurality of interchangeable members, which can be assembled in order to form several types of devices which can be used for physical culture and physiotherapy.

According to the invention, this object is achieved by an apparatus which is characterised in that it comprises at least two interchangeable connecting devices, each having at least one coupling means which cooperates with the coupling means of one of the hollow bodies, and in that a first connecting device has a plurality of rectilinear elements, each having a coupling means at each of its ends and which cooperates with the corresponding coupling means of one of the hollow bodies or one adjacent rectilinear element, and in that a second connecting device is constituted by two intermediate members, each having a coupling means which cooperates at one end with the corresponding coupling means of one of the hollow bodies and at the other end with further hollow bodies.

The invention is described hereinafter relative to a number of embodiments of the apparatus, with reference to the attached drawings, wherein.

Figure 4:
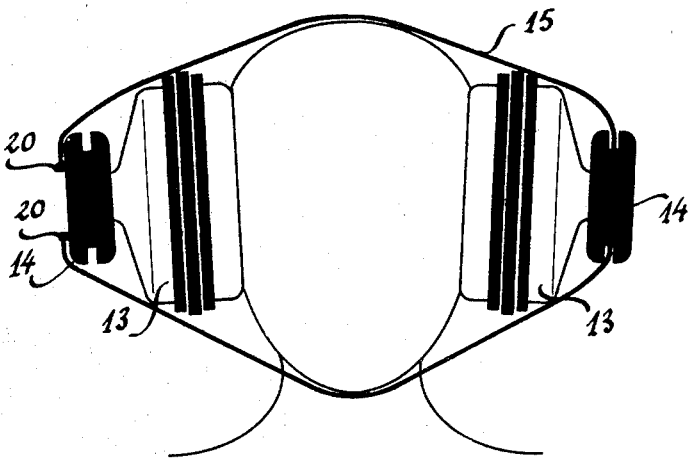

FIG. 4 a front view of the apparatus with two hollow bodies provided with intermediate members connected by a belt.

Figure 5A:
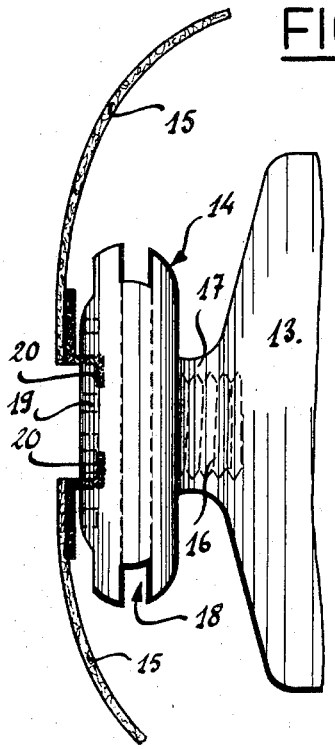
Figure 5B:
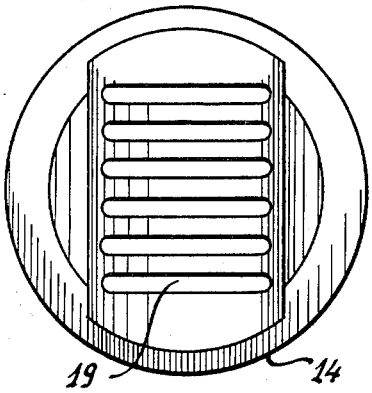

FIGS. 5*a* and 5*b* are respectively side and front views of an intermediate member used with the apparatus of FIG. 4.

Figure 6:
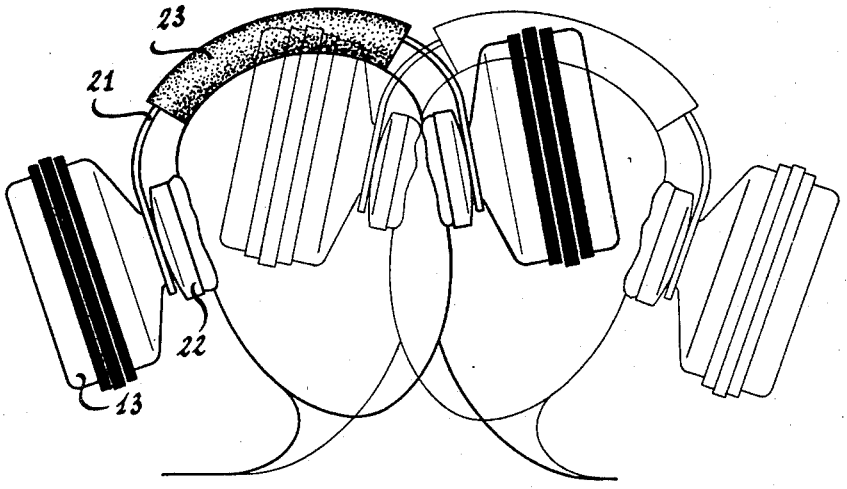

FIG. 6 is a front view of the apparatus in the form of a helmet.

FIG. 7 is a perspective view of one end of the apparatus provided with an attachment member connected to an elastic member.

FIGS. 8 and 9 show two possible utilizations of the apparatus of FIG. 7, respectively in the form of a dumb-bell and in the form of a bar.

Figure 1:
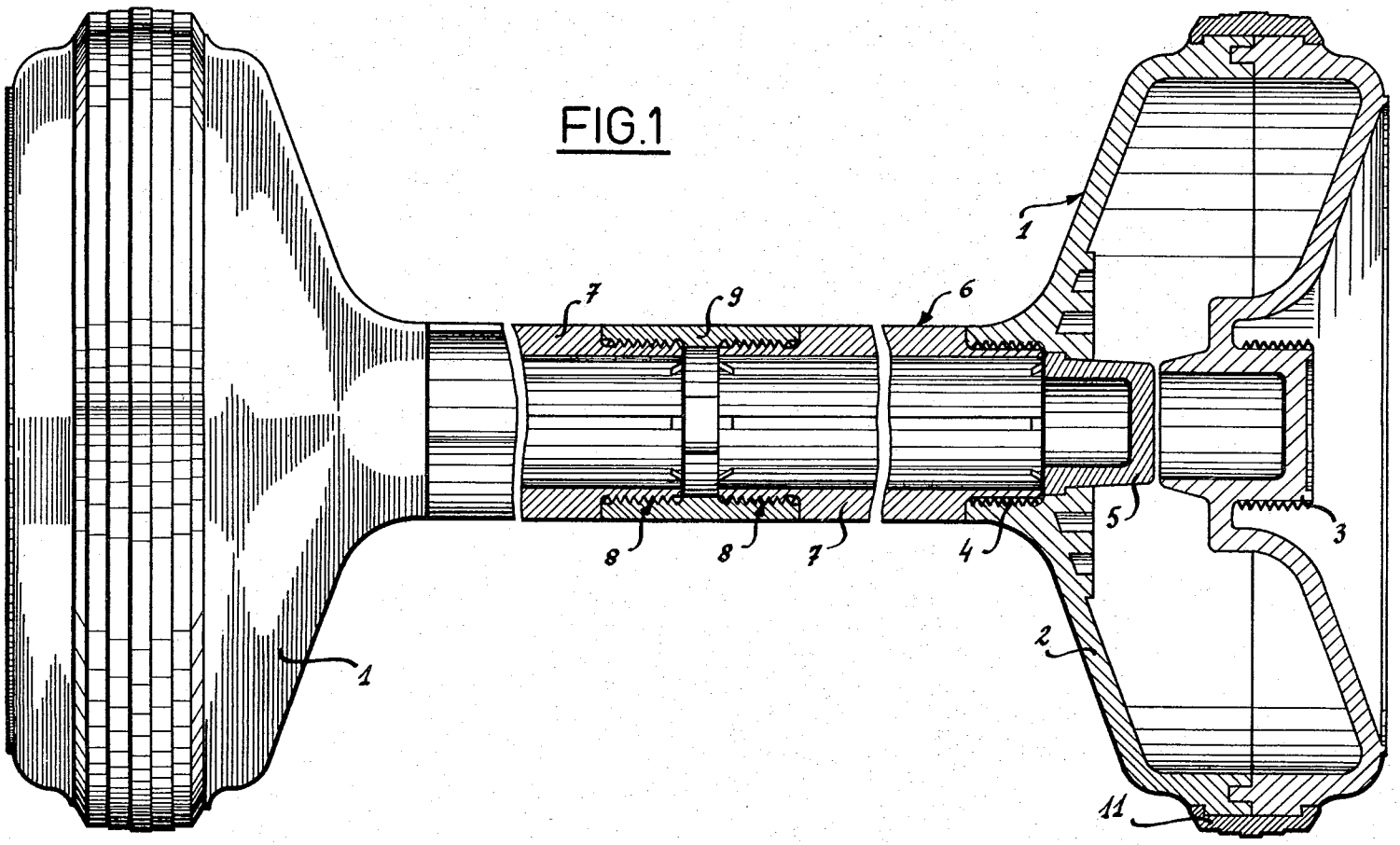
FIG. 1 is a part sectional view of the apparatus in the form of a dumb-bell.

The dumb-bell shown in FIG. 1 has two hollow bodies 1 such as described in U.S. Pat. No. 4,076,236 and has a casing 2 made from plastics material, whose external shape is chosen as a function of the esthetic effect which it is desired to give to the dumb-bell.

On one of the faces of each hollow body 1 the casing 2 forms a tubular skirt 3, whose outer wall has a thread. On the opposite face, casing 2 also has a skirt 4, whose inside wall has a thread and which surrounds an opening which, in the illustrated operating position, is sealed by a plug 5.

The dumb-bell also has a central bar 6 connecting the two hollow bodies 1, said bar being constituted by the assembly of a plurality of rectilinear elements 7, the two ends of each of these elements being provided in the present embodiment with a male thread 8 which, in the operating position, cooperates either with the inside thread of skirt 4 of hollow body 1 or with one of the two inside threads of an assembly member 9. The rectilinear elements 7 and the assembly members 9 are preferably made from a more rigid plastics material than that of the hollow bodies 1. Obviously, other coupling means can be provided for assembling the different rectilinear elements with a view to forming the dumb-bell connecting bar, this relating both to the assembly of the rectilinear elements with one another and with the terminal hollow bodies. Thus, for example, the rectilinear elements can be provided at one end with a male means and at the other end with a corresponding female means. The means can, for example, be threads, bayonet coupling means, press stud coupling means, etc.

The dumb-bell obtained in this way and illustrated in part sectional form in FIG. 1 can be used in the same way as a conventional dumb-bell. However, it has the advantage whilst using the same members for providing dumb-bells of different weights, as a function of the filling chosen for the hollow bodies, e.g. water, sand, lead, etc.

Figure 3:
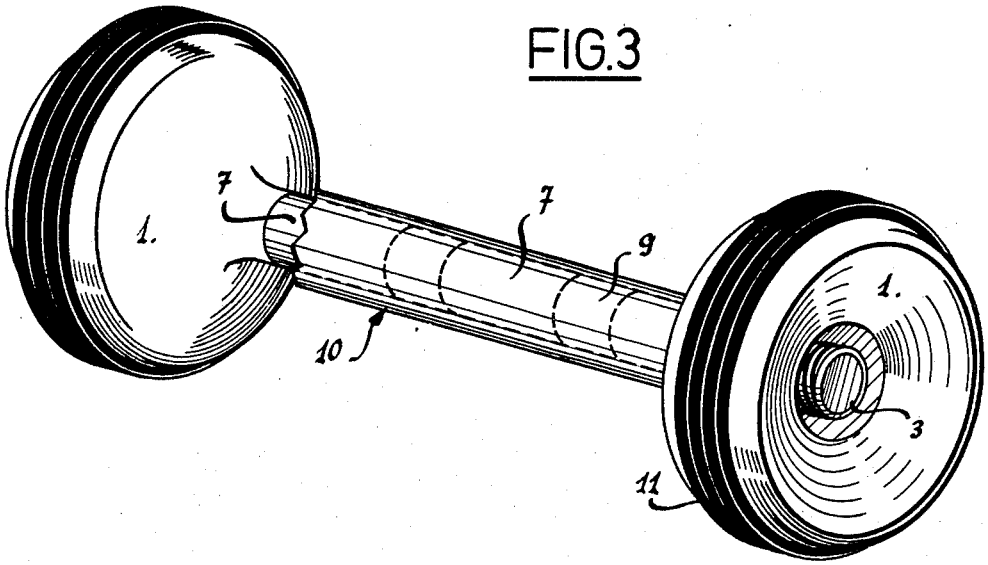

The apparatus according to the invention also has a sleeve 10 which can rotate freely on the connecting bar 6 of a dumb-bell, as illustrated in FIG. 3. The dumb-bell can then be used for muscle building exercises or physiotherapy movements on the ground, the hollow bodies 1 being provided with treads 11, e.g. of rubber.

Figure 2:
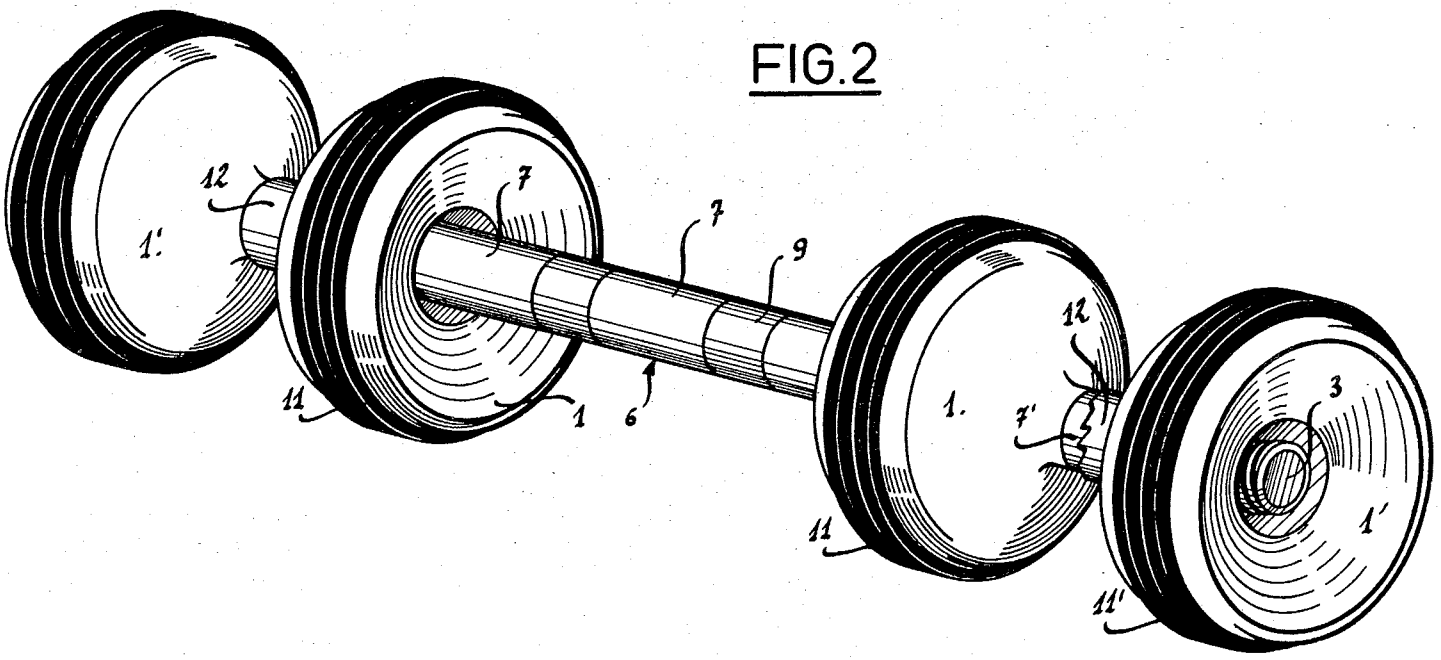
FIGS. 2 and 3 are perspective views of the apparatus in the form of a dumb-bell with a rotary sleeve, respectively with two supplementary hollow bodies at either end of the connecting bar.

As illustrated in FIG. 2, the apparatus according to the invention also has two supplementary hollow bodies 1' with treads 11' which can be mounted at the end of two supplementary rectilinear elements 7', themselves cooperating with the outer thread of the tubular skirt 3 of hollow bodies 1. In addition, a sleeve 12 is freely rotatably mounted on each of the two supplementary rectilinear elements 7'. In this case the same type of exercises can be carried out as with the apparatus of FIG. 3, however, the user is obliged to work with arms spread apart holding sleeves 12, which is advantageous for a certain number of exercises and in particular for physiotherapy of the back and abdomen.

According to a variant of the invention illustrated in FIGS. 4 and 5, the connecting device for the two hollow bodies 13 of the apparatus is constituted by two intermediate members 14, each cooperating with one of the hollow bodies 13 and connected by a regulatable belt 15. Each intermediate member 14, which is also made from a plastics material, has a coupling means 16, for example a male coupling means and has an outer thread, said means 16 being screwed into an inner thread on skirt 17 provided on one face of hollow bodies 13 (see FIG. 5*a*). The latter are made in the same way as the hollow bodies 1, 1' of the constructions described hereinbefore. The intermediate member 14 also has a passage 18 through which passes the belt 15, as well as slots 19 into which can be hooked the ends 20 of belt 15. As illustrated in FIG. 4, this device is intended to be fixed to the head of the user, one face of the hollow bodies 13 being in contact with the ears and the sides of the head, whilst the belt passes over the top of the head on the one hand and beneath the chin on the other.

The apparatus according to the invention also has another connecting device for the hollow bodies 13 constituted by a rigid or semi-rigid arched member 21, each end of which is fixed between the hollow body 13 and a supporting member 22, the latter having for example an inside thread in which is screwed the coupling means with outside thread of hollow body 13. The construction illustrated in FIG. 6 can be placed on the users' head in the same way as a helmet or the like with earphones, the arched member 21 being covered with a protective covering 23.

The two devices described hereinbefore with reference to FIGS. 4, 5 and 6 can be used with particular advantage for example for muscle building exercises on the nape of the neck or for physiotherapy of lesions to the cervical vertebrae.

Finally and according to another variant of the invention illustrated in FIGS. 7 to 9, the apparatus can have at its ends a cover or cap 24 having an attachment means 25 and which is screwed onto the terminal threaded skirt 3 provided on each hollow body or the ends of a bar constituted by the assembly of a plurality of rectilinear elements.

The apparatus also has elastic cords 26, whose one end is provided for example with a not shown grip or a loop, and whose other end is connected to an attachment plate 28, for example by interposing a hook 27. The attachment plate 28 has an opening 29 which cooperates in the operating position with the attachment means 25 of the screw cap 24. Thus, the apparatus according to the invention can be used, as illustrated in FIGS. 8 and 9, on the one hand in the form of a dumb-bell for exercises on the ground and on the other in the form of a bar for exercising in the standing position, whereby in both cases an elastic cord is attached to each end of the dumb-bell or bar.

The apparatus according to the invention consequently has the advantage of providing, through its interchangeable members, a number of devices which can be used for physical culture and physiotherapy in general.

Moreover, the apparatus can be easily transported, because it is disassemblable and the components are generally made from a plastics material and therefore have a limited weight. Obviously, during use, the hollow bodies can be filled with different types of materials, depending on the desired weight.

Finally, the cost of such an apparatus is relatively low, due to the small quantity of plastics material used for making the different hollow components.

The embodiments of the invention in which an exclusive property or privilege is claimed are defined as follows:

1. In apparatus for physical culture and physiotherapy comprising at least two hollow bodies, each said body having a filling opening sealed by a plug and coupling device on opposite sides of the body, and elongated handle means detachably interconnecting the two bodies and secured at one end of the handle means to the coupling device of one hollow body and at the other end of the handle means to the coupling device of the other hollow body; the improvement in which said handle means comprises at least two rectilinear elements, one of the elements being detachably connected to the coupling device of one said body and another of the elements being detachably connected to the coupling means of the other body, said coupling device including a coupling means detachably interconnecting the rectilinear elements, a rotatable sleeve covering said handle means, further said rectilinear elements on the sides of said hollow bodies opposite said handle means and detachably connected to said coupling means of said hollow bodies, and further hollow bodies detachably interconnected with said further rectilinear elements at a distance from the first-mentioned hollow bodies.

2. Apparatus as claimed in claim 1, and rotatable sleeves covering said further rectilinear elements.

3. In apparatus for physical culture and physiotherapy comprising at least two hollow bodies, each said body having a filling opening sealed by a plug and coupling device on opposite sides of the body, and elongated handle means detachably interconnecting the two bodies and secured at one end of the handle means to the coupling device of one hollow body and at the other end of the handle means to the coupling device of the other hollow body; the improvement in which said handle means comprises at least two rectilinear elements, one of the elements being detachably connected to the coupling device of one said body and another of the elements being detachably connected to the coupling means of the other body, said coupling device including a coupling means detachably interconnecting the rectilinear elements, a rotatably sleeve covering said handle means, said apparatus having two covers or caps each of which has a coupling means and an attachment means, said last mentioned coupling means serving for attachment to the outer sides of the hollow bodies, and two elastic cords one end of which is provided with an attachment member for securement to the attachment means on the caps or covers, and handles on the ends of the elastic cords opposite the attachment members.

* * * * *